United States Patent [19]

McDonald et al.

[11] 4,012,002

[45] Mar. 15, 1977

[54] AUTOMATIC COUPLING MECHANISM FOR HOSE REELS

[75] Inventors: Dean McDonald; Michael R. Williams, both of Jonesboro, Ark.

[73] Assignee: FMC Corporation, San Jose, Calif.

[22] Filed: May 19, 1976

[21] Appl. No.: 687,777

[52] U.S. Cl. ..... 242/54 R; 242/86

[51] Int. Cl.[2] ..... B65H 75/00; B65H 75/38

[58] Field of Search ..... 242/86, 54 R, 46.2, 242/46.21, 46.4, 46.5, 46.6, 46.7, 46.8; 57/92

[56] References Cited

UNITED STATES PATENTS

| | | | |
|---|---|---|---|
| 1,506,517 | 8/1924 | Dowrelio | 242/86 |
| 2,650,771 | 9/1953 | Marion | 242/54 R |
| 2,930,539 | 3/1960 | Bremer | 242/86 X |

*Primary Examiner*—Edward J. McCarthy
*Attorney, Agent, or Firm*—R. S. Kelly; C. E. Tripp

[57] ABSTRACT

A coupling mechanism for use in conjunction with a hose reel to automatically and selectively engage or disengage the reel and a motorized drive train. The coupling utilizes a sliding contact element on the drive train which is arranged to automatically engage one of a series of cooperating stop lugs on the reel to transmit the driving power of the motor to the rotatable reel. When the contact element is placed in a first position, it will be disengaged from the stop lug on the reel to allow the reel to rotate freely. When the contact element is shifted radially outwardly to a second position, it will automatically engage a stop lug, causing the reel to rotate under the power of the motor. The radial shifting of the contact element between the two positions can be controlled by stopping the drive train at selected orientations. Also located within the coupling mechanism is a friction element designed to control through a drag force the movement of the reel when it is disengaged from the drive train.

8 Claims, 4 Drawing Figures

AUTOMATIC COUPLING MECHANISM FOR HOSE REELS

BACKGROUND OF THE INVENTION

1. Field of the Invention

This invention pertains to large reels such as those used to store long hoses of several hundred feet or more in length, and more particularly, it relates to a coupling mechanism for selectively engaging or disengaging the reel and a motorized drive train.

2. Description of the Prior Art

Present hose reels are normally equipped with either manual crank drives or electrical drives. However, most lower priced electrical drive reels are not equipped with enough power to adequately handle the heavy loads associated with hose reels that hold several hundred feet of hose, such reels requiring very large forces to pull the great lengths of hose. Consequently, even those hose reels driven by an electric motor must be assisted manually in many cases. Larger motors could be utilized, but in view of various physical and economical limitations their use is generally not practical. Thus, it is normally necessary to greatly gear down the drive train to provide the requisite pulling force with the size of motor available.

Since many of the typical operations that utilize reels holding very long hoses require continued unrolling of the hose and the rerolling of the hose on the reel several times in one day, serious operator fatigue usually results for, even with a motor, the operator must be continually assisting in the rerolling operation of the reel.

As pointed out, one partial solution to the problem of finding an inexpensive operator assist in hose reeling operations has been the use of a gear-down arrangement with a small electric motor to allow the motor to help to roll the hose onto the reel. Because of their high power output, permanent magnet DC motors are much more desirable than wound rotor motors for this type of operation. A problem remains, however, with respect to the high ratio reduction drive because of the large drag force encountered upon the rotation of the drum when the motor is not being used and as the operator unrolls the hose from the reel. This is the result of the permanent magnet effect of the DC motor amplified many times through the drive train.

It is, therefore, highly desirable to have a means for disconnecting the DC drive motor during unreeling operations where the operator wishes to maintain full control of the operation by pulling the required length of hose when and where he needs it. Clutches and other decoupling devices which have been heretofore used for such a purpose are generally complicated and relatively expensive mechanisms.

SUMMARY OF THE INVENTION

The present invention comprises a coupling means mounted between a drive mechanism and a rotatable reel and arranged to automatically engage or selectively disengage the rotatable reel and the drive mechanism. The coupling means utilizes a slidable contact element mounted on a drive member connected to the drive mechanism which is engageable with one of a series of cooperating stop lugs located on the rotatable reel. When the contact element is out of engagement with a lug, starting of the drive member will cause the slidable contact element to move radially outward relative to the rotating axis of the reel and assume a position for contact with one of the stop lugs for driving the reel by the power in the drive motor. Stopping the drive member at a certain rotative position causes the contact element to move radially inward relative to the pivot axis of the reel to allow disengagement between the contact element and the stop lug thereby permitting the reel to pivot freely independent of the drive mechanism. Stopping of the drive member in another rotative position, however, will maintain the coupling between the reel and the drive motor even though the drive motor is not supplying any power.

The coupling means of the present invention in its preferred form incorporates friction members to provide a dragging force on the reel, so that, when it is operating in its freely rotatable mode, it will not rotate in an uncontrolled manner so as to cause the hose to become inadvertently unwound from the reel.

With the use of the present invention an operator can automatically cause the coupling of the drive mechanism to wrap the hose on the reel by merely starting the drive motor. When the hose is fully rolled, the operator can position the drive mechanism in one orientation to disengage the drive mechanism from the reel and allow the reel to rotate freely to permit the unwrapping of the hose off the reel, or he can position the drive mechanism in an alternate orientation to maintain engagement with the reel and thereby prevent accidental unreeling of the hose.

DESCRIPTION OF THE PREFERRED EMBODIMENT

Figure 1:
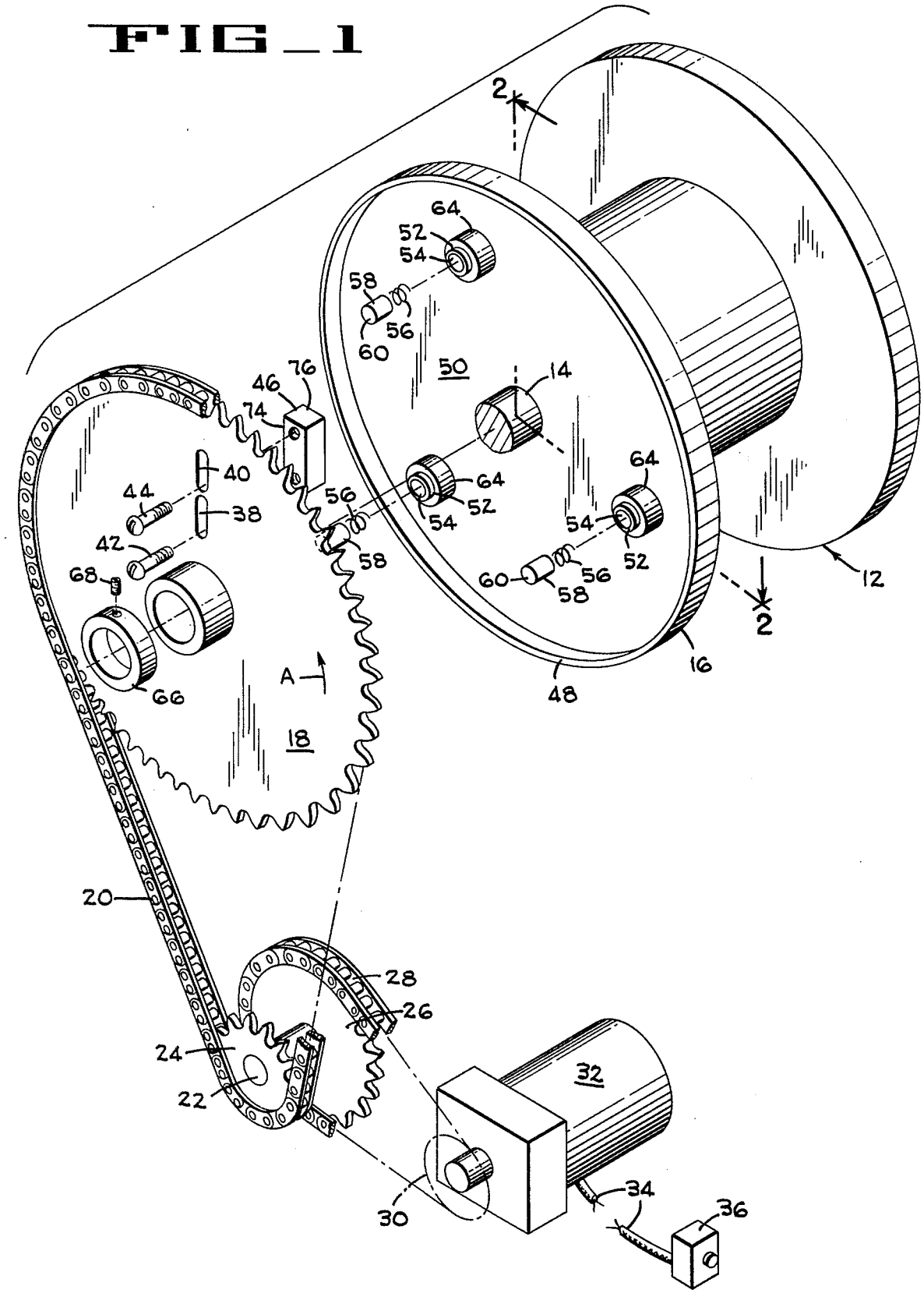
FIG. 1 is an exploded perspective view of the automatic coupling mechanism of the present invention.

The apparatus of the present invention is shown in its entirety in FIG. 1 and will be seen to include a large hose reel 12 rotatably mounted on a shaft 14. Mounted in juxtaposed relationship with one side wall 16 of the hose reel 12 is a drive member in the form of a large sprocket 18 having a diameter substantially the same as the diameter of the side wall of the reel. The sprocket 18 is connected through an endless chain 20 and a reducing sprocket 24 to a countershaft 22. Also mounted on the countershaft 22 is a power sprocket 26 which is driven through a power chain 28 and power sprocket 30 by a drive motor 32. The operation of the motor 32 can be controlled through conventional wire connections 34 which may extend to a remotely located control box 36.

Located on the drive sprocket 18 are a pair of radially aligned slots 38 and 40. Inserted respectively within these slots are attachment bolts 42 and 44 which slidably secure the contact, or engaging, element 46 to the drive sprocket. The width of each of the slots 38 and 40 is slightly greater than the diameter of each of the bolts 42 and 44 to freely allow the inwardly and outwardly shifting of the contact element 46 with respect to the axis of the drive sprocket 18.

Figure 2:
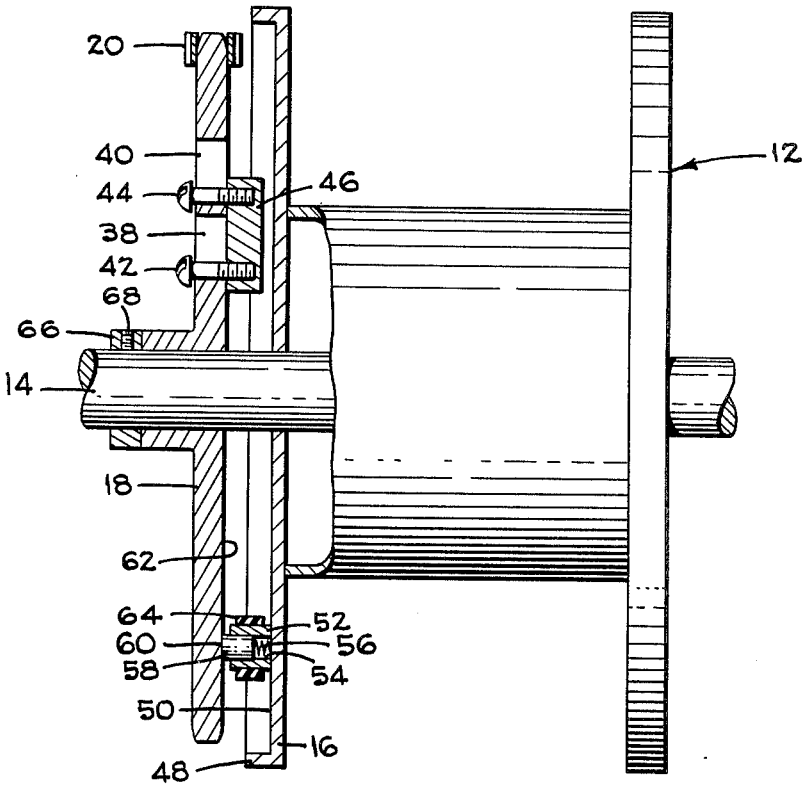
FIG. 2 is a partial section taken generally along line 2—2 of FIG. 1.

Uniformly spaced about a reference circumference 45 (see FIG. 4) adjacent an outer flange 48 on the recessed outer face 50 of the side wall 16 of reel 12 are a series of three lugs 52. Each of the lugs, or stops, contains a central recess 54 into which is fitted a spring 56 having a friction block 58 attached to its outermost end. As shown in FIG. 2, since the inner surface 62 of the drive sprocket 18 is in juxtaposed relation with the side wall 16 of the reel, the outer surface 60 of each of the friction blocks 58 is in spring biased contact with said inner surface of the drive sprocket and acts to retard the movement of the reel when the drive sprocket is inoperative. Also located around each of the stop lugs 52 is a shock absorbing sleeve 64 of rubber or the like which is used to dampen the contact between the contact element 46 and the engaged stop lug 52 as will be explained in greater detail hereinafter. The drive sprocket 18 is secured in close relationship with the side wall 16 of the reel by a thrust ring 66 and set screw 68 which secure the drive sprocket to the shaft 14 for rotation therewith.

Turning to the overall operation of the coupling mechanism of the present invention, it will be appreciated that when a long hose (not shown) has been unwrapped from the reel 12 and it is desired to wrap the hose back onto the reel, the control box 36 may be actuated to start the motor 32. The drive sprocket 18 is rotated in the direction of arrow A, so that, when the contact element 46 reaches a position somewhat below a horizontal plane through the shaft 14, it will slide radially outwardly on the connecting bolts 42 and 44 within the slots 38 and 40 toward the outer circumference 70 of the drive sprocket. Gravity forces on the contact element 46 will thus cause it to automatically slide radially outward, and it will be noted that any centrifugal forces imposed on the contact element (depending on its speed of rotation) will have the same effect. When the contact element 46 is in its outer position and proceeding about the axis of drive shaft 14 in the direction of arrow A (FIG. 4), its leading surface 74 will contact a stop lug 52 and push the lug in the direction of arrow A to thereby cause the reel 12 to turn in the same direction. It should be noted that the reel 12 is free to rotate on drive shaft 14 independently of the drive sprocket 18 whenever the contact element 46 is free of a stop lug.

The joint rotation of drive sprocket 18 and reel 12 will continue until the motor 32 is stopped by actuation of the control box 36. Because of the continuous torque exerted through the shaft 14 on the drive member 18 the contact element 46 will remain in contact with the engaged stop lug 52 throughout the winding operation even when the contact element passes above the horizontal plane through the drive shaft 14.

Figure 3:
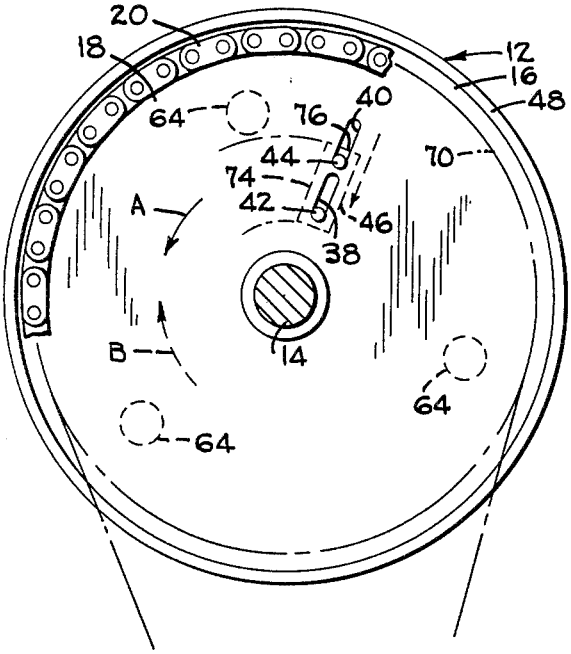
FIG. 3 is an end elevation showing the disengaged position of the contact element.

After the hose is completely wound onto the reel 12 and it is thereafter desired to unreel the hose by hand, the contact element must be disengaged from its contact with the stop lug 52. To accomplish this it may be necessary to activate the drive sprocket 18 to move it to a position wherein the contact element is in a generally vertical orientation over the shaft 14 as shown, for example, in FIG. 3. By starting and stopping the motor 32 a couple of times to cause a slight jerking motion on the drive sprocket 18, any frictional contact between the stop lug and the contact element is overcome allowing the contact element to slide radially inwardly on its attachment bolts 42 and 44 as shown in FIG. 3. Thus, the outer end 76 (FIG. 3) of the contact element will clear the stop lugs 52 and the reel 12 can be freely moved in its reverse direction, as shown by arrow B in FIG. 3, while the hose is unwrapped from the reel. There will be no heavy drag force exerted on the reel by the drive mechanism which is now completely disengaged from the reel. The drive sprocket 18 will remain essentially stationary while the reel is rotated in the house unwrapping direction of the arrow B.

As the hose is being unwound from the reel, however, it is desirable that a slight drag force be exerted on the reel, so that when the pulling motion on the hose is stopped the rotation of the reel will stop and not continue in a free wheeling manner so as to result in unwanted unwinding of the hose. The friction blocks 58 in the stop lugs 52 provide a slight drag force on the inner surface 62 of the stationary drive sprocket 18. Therefore, the reel 12 always experiences some slight drag force and will not be able to freely unwind without some direct force being applied to it through the pulling of the hose. The amount of this drag force may be varied by placing the drive sprocket 18 closer to or further from the reel 12 through adjustment of the thrust collar 66.

Figure 4:
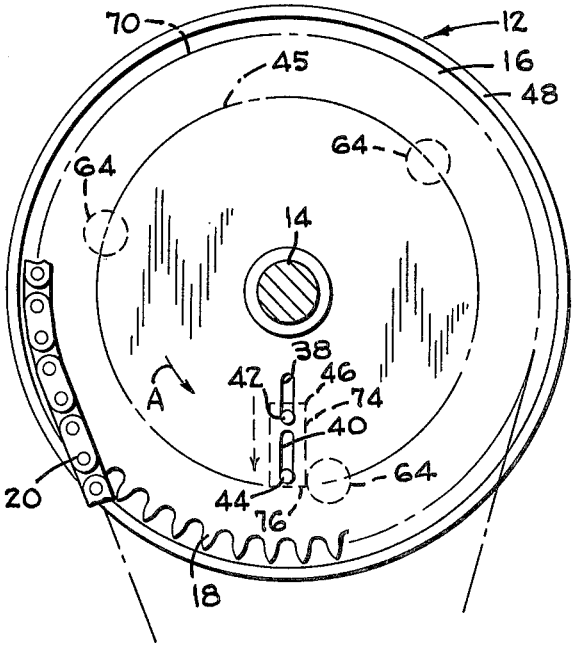
FIG. 4 is an end elevation similar to FIG. 3 but showing the engaged position of the contact element.

When it is desired to maintain engagement between the drive sprocket 18 and the reel 12 after the motor 32 has been stopped, it is only necessary to stop the drive when the drive sprocket is oriented so that the contact element is in the lower portion of its orbital path of travel as shown, for example, in FIG. 4. The contact element then maintains its engagement with the stop lug and prevents unwinding of the hose except through movement of the entire drive train--such movement requiring a substantial amount of pulling power. This maintenance of drive engagement is useful to prevent accidental unwinding of the hose as, for example, when the reel is being transported and is subject to jolts and jars or where the reel is elevated so that gravitational forces on the free end of the hose could cause automatic unwinding.

It will be seen that the present invention provides a simple yet effective means of automatically coupling and de-coupling hose reels to a power drive train. The parts can be manufactured quite economically, and the reliability of the device is very high.

Although the best mode contemplated for carrying out the present invention has been herein shown and described, it will be apparent that modification and variation may be made without departing from what is regarded to be the subject matter of the invention.

What is claimed is:

1. A reeling apparatus comprising:

a motor;

a rotatable drive member in driving communication with said motor;

a reel mounted in juxtaposed relationship with said drive member; and coupling means movably mounted upon said drive member for engaging said reel when said drive member is moved into a first rotative position and for disengaging said reel when said drive member is moved into a second rotative position.

2. A reeling apparatus as defined in claim 1 wherein said coupling means comprises a slidable contact element, and a lug mounted on said reel for contact with said contact element when said contact element is in said engaging position.

3. A reeling apparatus as defined in claim 1 including a plurality of circumferentially spaced lugs mounted on said reel.

4. A reeling apparatus as defined in claim 1 and additionally comprising:

means mounted between said drive member and said reel for providing a friction force on said reel active when said drive member is disengaged from said reel.

5. A reeling apparatus comprising:

a reel;

a drive member rotatably mounted adjacent said reel;

a motor in driving communication with said drive member;

a plurality of circumferentially spaced stopping members mounted on the face of said reel closest said drive member; and an engaging element slidably mounted on the surface of said drive member facing said face of said reel, said engaging element sliding radially outwardly when said drive member is started to contact one of said stopping members and said engaging element sliding radially inwardly and out of the path of said stopping members when said drive member is stopped in a rotative orientation so that said engaging element is positioned in an upper portion of its orbital path.

6. In a reeling apparatus comprising a reel and a drive train including a rotatable drive member mounted directly adjacent to said reel, a coupling mechanism comprising a latch, means for slidably mounting said latch on said drive member so that it may freely slide in a radial direction, and a stop member mounted on said reel in a position to be engaged by said latch when said latch is in its radially outer position.

7. In a reeling apparatus according to claim 6 including a plurality of stop members circumferentially spaced about the circumference of said reel.

8. In a reeling apparatus according to claim 6 wherein said drive member comprises a sprocket and said latch member includes a bolt slidable through an aperture in said sprocket.

* * * * *